US006209720B1

(12) United States Patent
Chen

(10) Patent No.: US 6,209,720 B1
(45) Date of Patent: Apr. 3, 2001

(54) BOX STRUCTURE FOR INTELLECTUAL CUBE

(75) Inventor: Sen-Li Chen, Kaohsiung Hsien (TW)

(73) Assignee: East Sheen Industrial Co., Ltd., Hsien (TW)

( * ) Notice: Subject to any disclaimer, the term of this patent is extended or adjusted under 35 U.S.C. 154(b) by 0 days.

(21) Appl. No.: 09/476,999

(22) Filed: Jan. 4, 2000

(51) Int. Cl.[7] ..... B65D 85/20; B65D 5/50; A63F 9/06; F16M 11/00

(52) U.S. Cl. ..... 206/315.1; 206/765; 211/85.7; 248/146; 248/176.1; 248/180.1; 273/153 R; 312/284

(58) Field of Search ..... 206/315.1, 756, 206/765, 769, 486, 563; 273/153 R, 155, 157 R, 241; 248/176.1, 146, 180.1; 211/13.1, 85.7, 133.1; 312/284, 114

(56) References Cited

U.S. PATENT DOCUMENTS 2,663,419 * 12/1953 Bolding et al. ..... 206/563
3,658,413 * 4/1972 Cornell ..... 40/720
3,771,795 * 11/1973 Flanigen ..... 273/157 R
3,888,443 * 6/1975 Flanigen ..... 206/315.1
4,210,332 * 7/1980 Shanin ..... 273/157 R
4,257,609 * 3/1981 Squibbs ..... 273/241
4,574,960 * 3/1986 Shikatani ..... 211/60.1
4,934,517 * 6/1990 Ho ..... 312/289 X
6,047,833 * 4/2000 Solomon ..... 206/315.1 X

* cited by examiner

*Primary Examiner*—Bryon P. Gehman
(74) *Attorney, Agent, or Firm*—Bacon & Thomas

(57) ABSTRACT

A box structure specifically for disposing an intellectual cube for displaying and as a packing box is disclosed. The box structure is comprised of a base and a transparent cover, the base is provided with a surrounding annular groove to allow the cover to place thereon for covering. The base is provided on the top thereof with a disk-shaped receiving platform having therein a groove for a wedge-shaped part and a groove for a pyramid-shaped part. With angular difference of the grooves, the intellectual cube packed can be disposed in multiple orientations; and the inner wall of the transparent cover abuts the upper corners of the intellectual cube to prevent the intellectual cube from shaking in the box during shipping and selling.

8 Claims, 9 Drawing Sheets

BOX STRUCTURE FOR INTELLECTUAL CUBE

BACKGROUND OF THE INVENTION

1. Field of the Invention

The present invention is related to a box structure for disposing intellectual cubes in multiple orientations for displaying and as a packing box, the intellectual cubes in the box structure will not be subjected to displacement when in shipping.

2. Description of the Prior Art

An intellectual cube is a square cube having same amount of check like sections in each side thereof, these checks can be moved relative to one another to get an indicated arrangement for the purpose of enhancing intellectuality.

SUMMARY OF THE INVENTION

The primary object of the present invention is to provide a box structure for disposing an intellectual cube for displaying and as a packing box. The box structure is comprised of a base and a transparent cover, the base is provided with a surrounding annular groove to allow the cover to place thereon for covering. The base is provided on the top thereof with a disk-like receiving platform having therein a groove for a wedge-shaped part and a groove for a pyramid-shaped part, with angular difference of the grooves, the intellectual cube can be disposed in multiple orientations for enhancing efficiency of display.

Another object of the present invention is to provide a box structure, wherein when the base and the transparent cover are put together by covering, no matter which orientation the intellectual cube is allocated, the inner wall of the transparent cover abuts the upper corners of the intellectual cube to prevent the intellectual cube from shaking in the box, thereby the intellectual cube is well protected.

Another object of the present invention is to provide a box structure for convenience of packing of the intellectual cube. With which, the intellectual cube is prevented from shaking in the box and can be displayed. Packing of the intellectual cube can be completed when it is well placed in the box, and can be sold directly. By such packing, commercial value of the intellectual cube can be increased.

A further object of the present invention is to provide a box structure for convenience of displaying of a plurality of intellectual cubes. A bench is provided for this purpose, and is provided on the top thereof with a plurality of insertion seats for inserting in the bottom of a plurality of bases. Thereby, the intellectual cubes can be disposed in various orientations on different bases. This arrangement allows a plurality of intellectual cubes to be disposed on the bench in various orientations for displaying.

The present invention will be apparent in its practical structure and objects after reading the detailed description of the preferred embodiments thereof in reference to the accompanying drawings.

DETAILED DESCRIPTION OF THE PREFERRED EMBODIMENT

Figure 1:
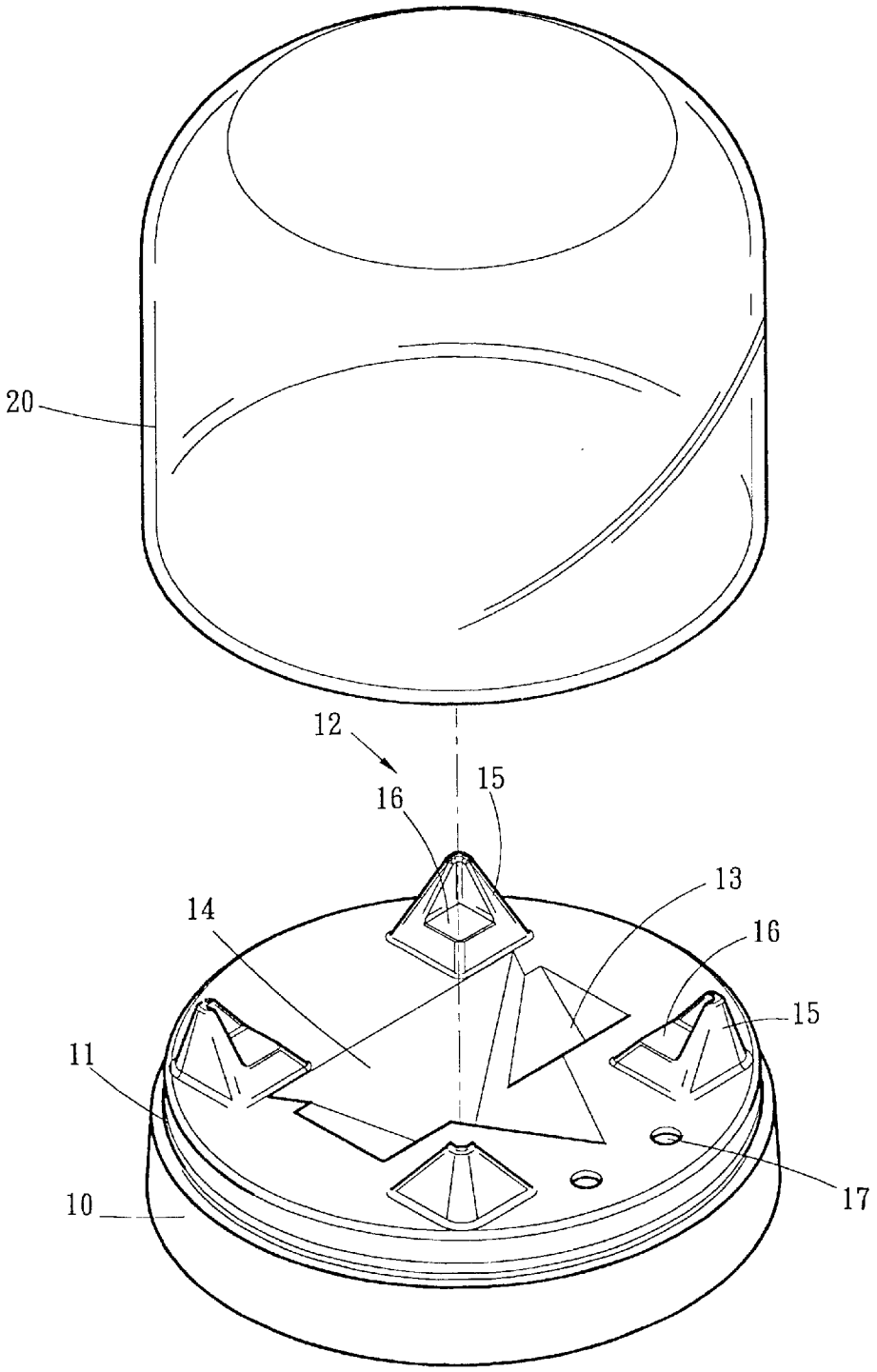
FIG. 1 is a perspective view of the present invention.
Figure 2:
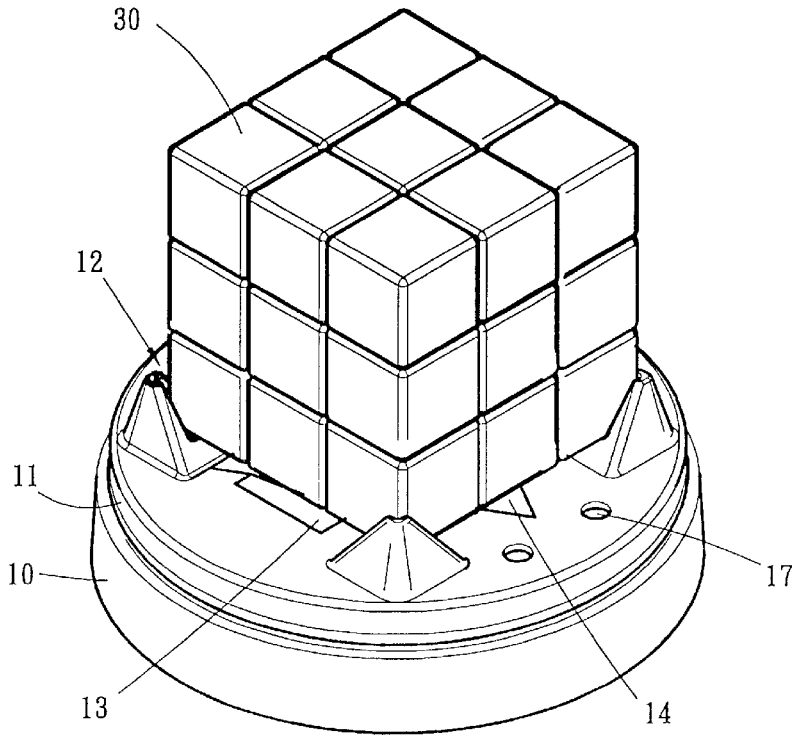
FIG. 2 is a perspective view of the first embodiment of the present invention.
Figure 8:
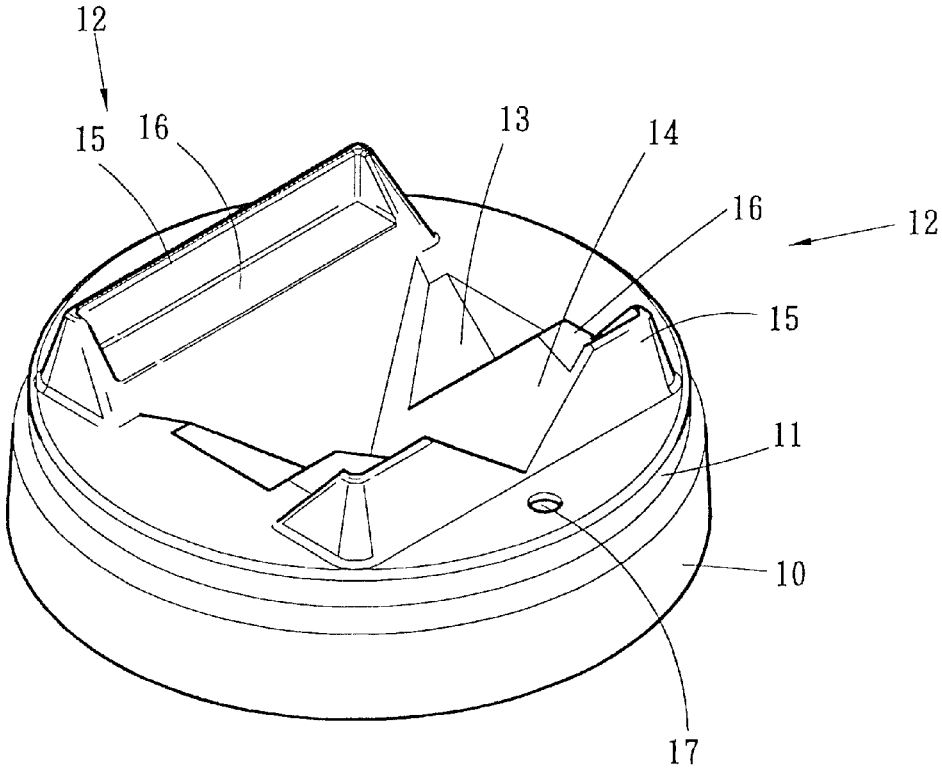
FIG. 8 shows another embodiment of the present invention.

Referring to FIG. 1, an intellectual cube 30 of the present invention is comprised of a base 10 and a transparent cover 20, wherein:

The base 10 is provided with a surrounding annular groove 11, and is provided on the top thereof with a disk-like receiving platform 12 having therein a groove 13 for a wedge-shaped part and a groove 14 for a pyramid-shaped part, with angular difference of the grooves, the intellectual cube 30 can be disposed in multiple orientations (also referring to FIGS. 2, 3, 4 and 6). Wherein, the disk-like receiving platform 12 is provided with a plurality of protruding seats 15 corresponding in positions to those of the four corners of the intellectual cube 30 (as shown in FIGS. 1 or 8). The protruding seats 15 are provided each with an open groove 16; the distance between every two open grooves 16 is exactly for embedding of the intellectual cube 30 within the limitation of the four protruding seats 15. The groove 13 for a wedge-shaped part is formed directly by providing a "V" shaped groove on the top surface of the base 10, and can be inserted obliquely therein the intellectual cube 30. The groove 14 for a pyramid-shaped part is formed directly by providing an inversed pyramid-shaped groove on the top surface of the base 10, and can be inserted therein a pyramid-shaped part of the intellectual cube 30.

The transparent cover 20 is for embedding in the surrounding annular groove 11 of the base 10; the inner surface of the transparent cover 20 exactly abuts on the upper corners of the intellectual cube 30.

Referring again to FIGS. 2, 4 and 6, the base 10 of the present invention can afford insertion of the intellectual cube 30 in various orientations. Such a feature allows a seller to optionally adjust the orientation of the intellectual cube 30 relative to viewing directions of customers for displaying. And plural intellectual cubes 30 can be disposed on a showcase after they are mounted on a plurality of bases 10 in various orientations. Thereby, the intellectual cubes 30 can be displayed for customers in such various orientations to enhance efficiency of displaying.

Figure 3:
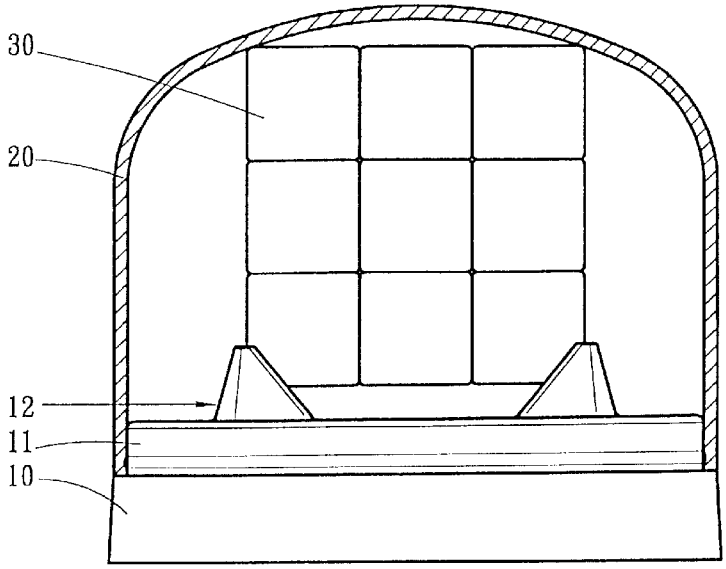
FIG. 3 is a front view of the first embodiment of the present invention.
Figure 4:
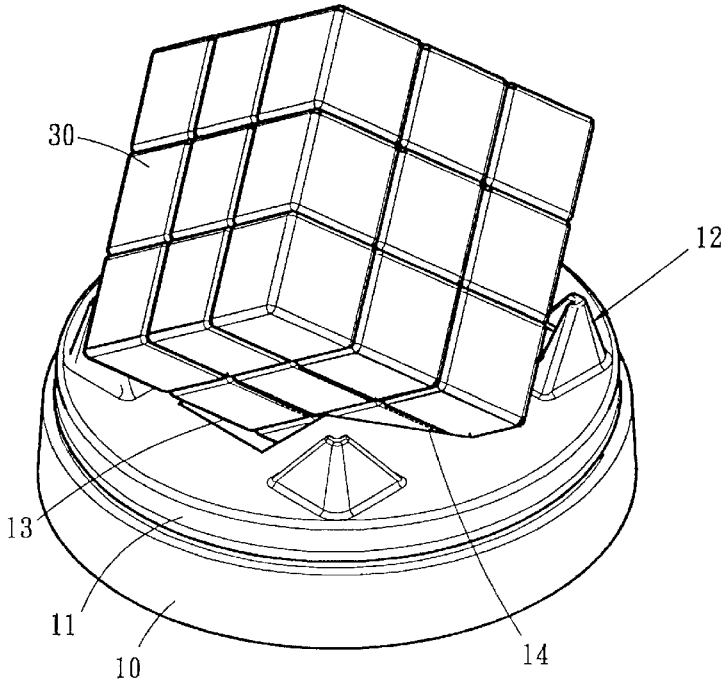
FIG. 4 is a perspective view of the second embodiment of the present invention.
Figure 5:
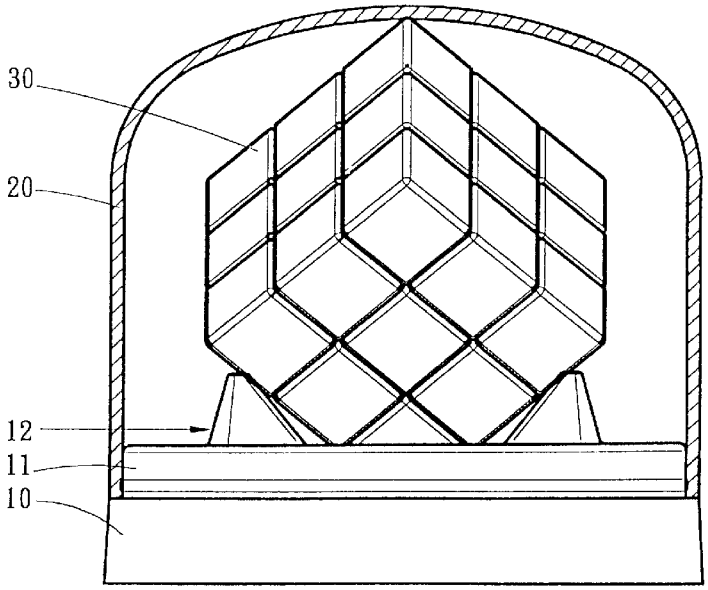
FIG. 5 is a front view of the second embodiment of the present invention.
Figure 6:
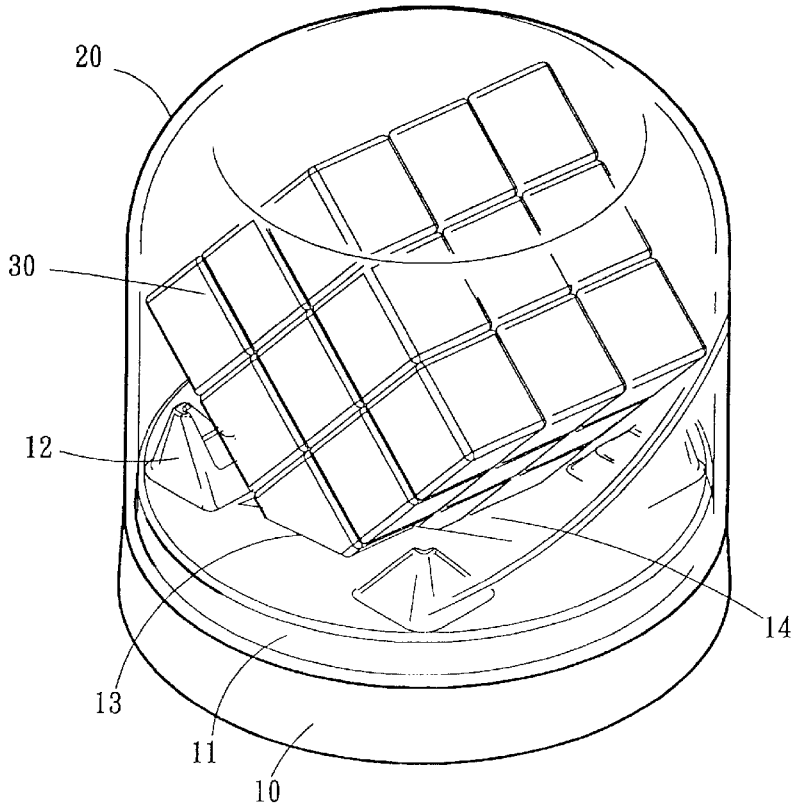
FIG. 6 is a perspective view of the third embodiment of the present invention.
Figure 7:
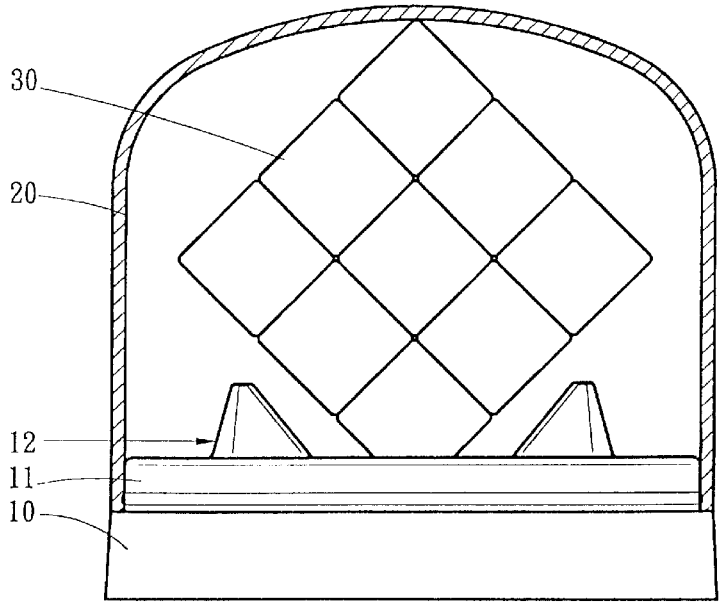
FIG. 7 is a front view of the third embodiment of the present invention.

And as shown in FIGS. 3, 5 and 7, when an intellectual cube 30 is mounted on a base 10 in any desired orientation, and when a transparent cover 20 covers the base 10, the inner wall of the transparent cover 20 will abut on the upper corners of the intellectual cube 30. In this way, the intellectual cube 30 packed in the box structure will not be subjected to shaking and damage when in shipping.

And more, the base 10 is provided on the top thereof with through holes 17 in order to provide air flow, irrespective of whether the transparent cover 20 covers the base 10 or is removed therefrom, to prevent difficulty of covering or removing induced by difference of air pressure.

Figure 9:
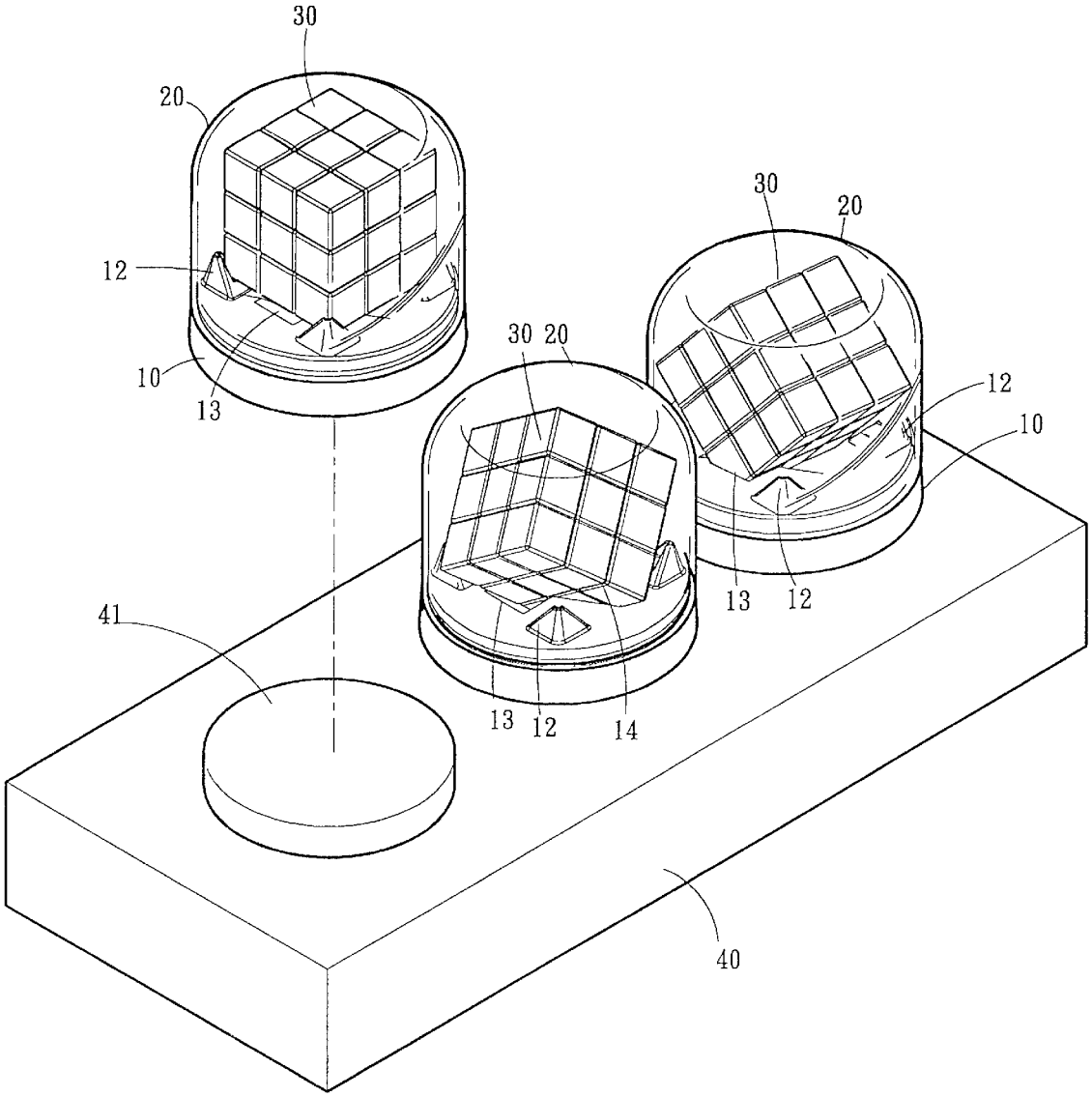
FIGS. 9, 10, 11 and 12 are embodiments showing using of the present invention on various benches.
Figure 10:
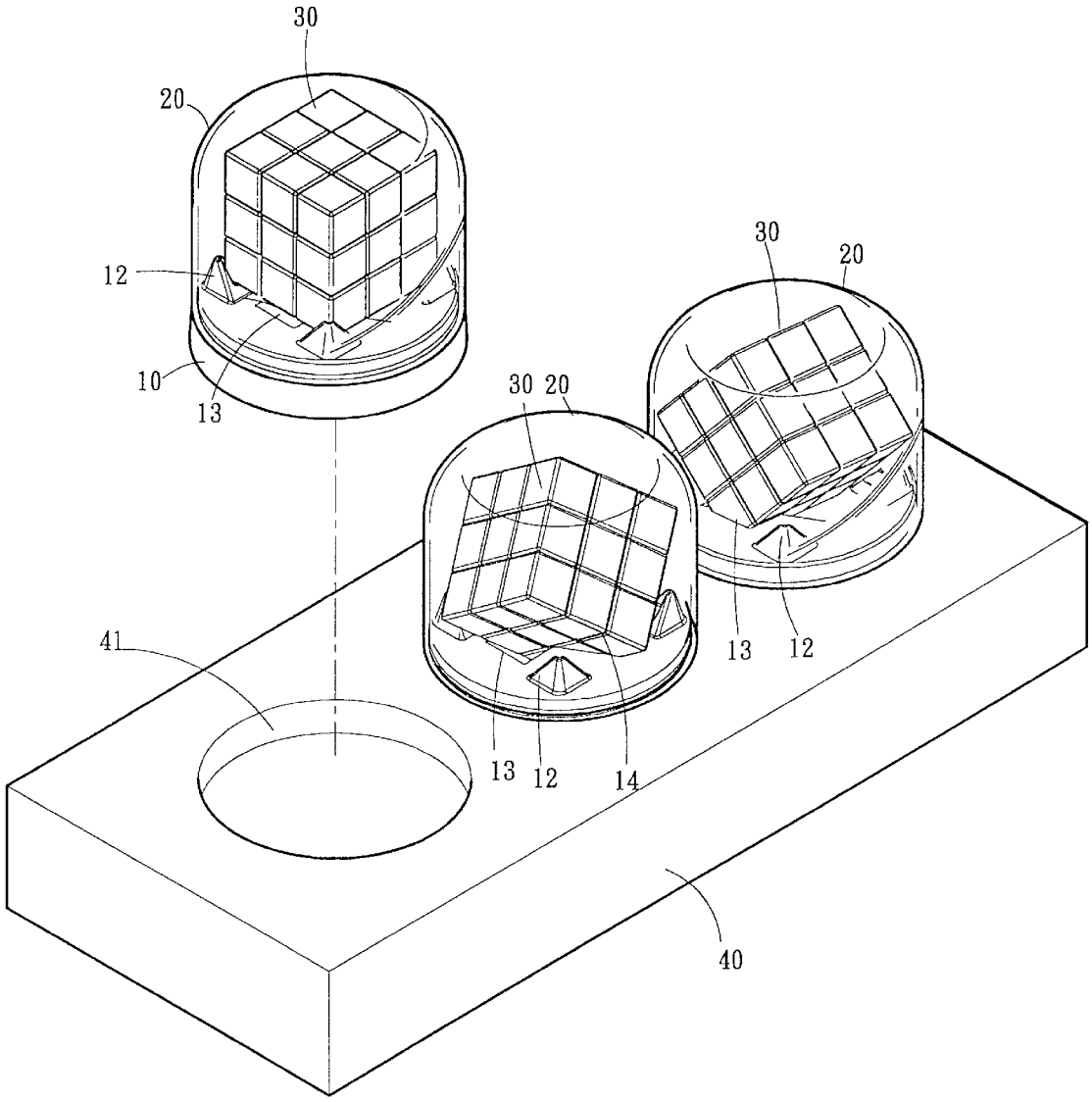

As shown in FIGS. 9 and 10, when in displaying or packing an intellectual cube of the present invention, a bench 40 is provided, and is provided on the top thereof with a plurality of insertion seats 41 for inserting in the bottom of a plurality of bases. Shapes of the insertion seats 41 are not limited; they can be a trough or a convex style. The bench 40 is provided for arrangement of a plurality of bases 10. A plurality of intellectual cubes 30 can be placed on these bases 10 in different orientations, and the bases 10 are then assembled on the bench 40 to have the intellectual cubes 30 placed thereon in different orientations. The commercial value of the intellectual cubes 30 can then be increased.

Figure 11:
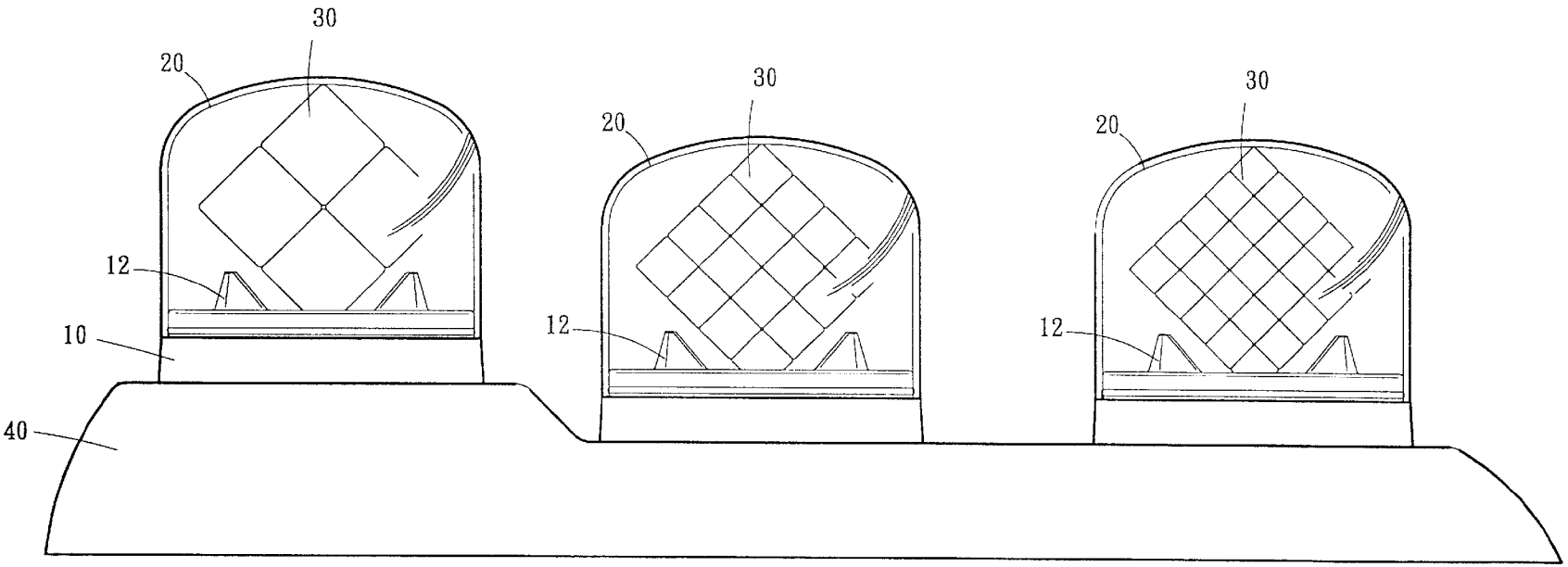
Figure 12:
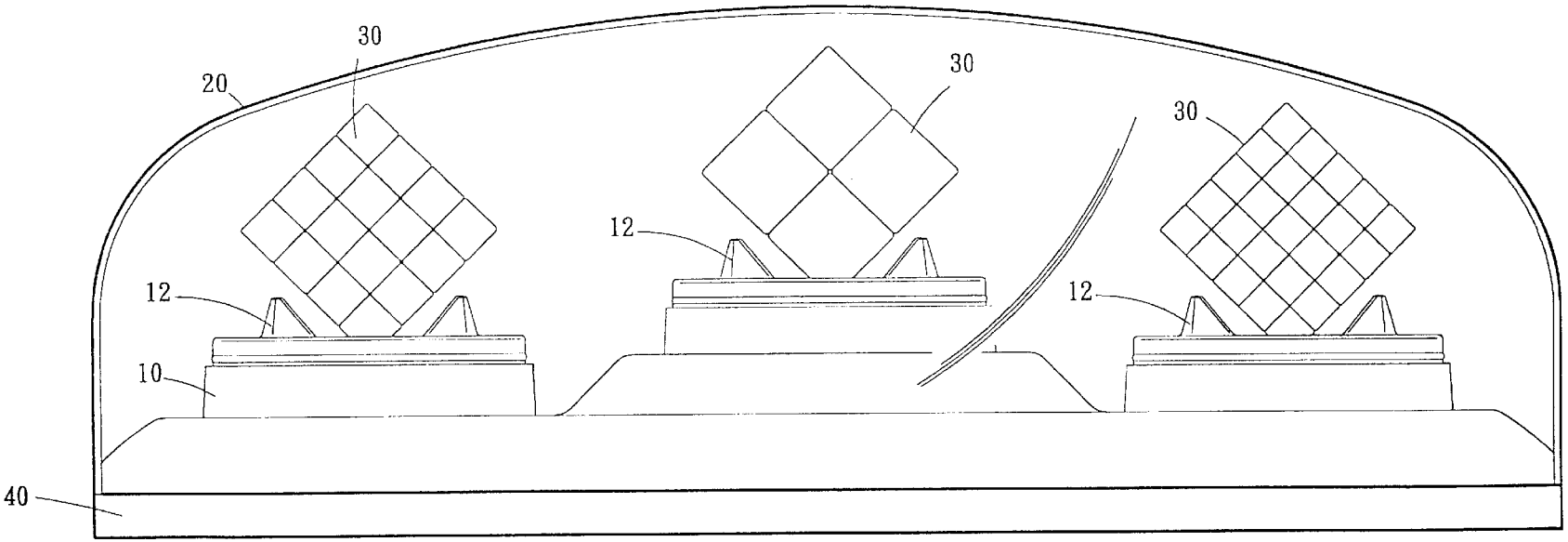

As shown in FIGS. 11 and 12, by virtue that magic intellectual cubes have a variety of specifications, such as 2×2×2, 4×4×4, 5×5×5 etc., the above stated bench 40 is used to make an arrangement for displaying used for packing, this can increase effect of displaying. And the transparent cover 20 covering the bases 10 can also be manufactured in a shape corresponding to that of the bench 40. And the objects of displaying and packing can be achieved.

The present invention not only is beneficial to variation of angular disposition of the intellectual cubes, but also is beneficial to protection of the intellectual cubes during shipping and transporting the latter, for the intellectual cubes are well packed.

In conclusion, the box structure for intellectual cubes of the present invention can display the intellectual cubes in different orientations when it is well packed. The intellectual cubes will not shake in the box during shipping. The box structure is novel and improved.

Having thus described my invention, what I claim as new and desire to be secured by Letters Patent of the United States are:

1. A box structure for displaying an intellectual cube, said box comprising a base and a transparent cover wherein:

said base is provided with a surrounding annular groove, and is provided on the top thereof with a disk-shaped receiving platform having a wedge-shaped groove therein, said wedge-shaped groove being configured for disposing a corresponding wedge-shaped portion of an intellectual cube in said wedge-shaped groove;

disk-shaped receiving platform is further provided with a plurality of protruding seats corresponding in positions to those of the four corners of the said intellectual cube, the protruding seats are provided each with an open groove; the distance between every two of said open grooves is exactly for embedding of the intellectual cube within the limitation of said four protruding seats;

the platform further including an inversed pyramid-shaped groove therein for disposing a corresponding pyramid-shaped part of the intellectual cube therein;

whereby the intellectual cube is displayable in said box in multiple orientations.

2. The box structure of claim 1 wherein said wedge-shaped groove is formed directly by providing a V shaped groove on a top surface of said base so that the intellectual cube can be inserted obliquely therein.

3. The box structure of claim 1 wherein an inner surface of said transparent cover exactly abuts on the upper corners of the intellectual cube when said transparent cover covers said base and said intellectual cube is embedded in the open grooves of said protruding seats.

4. The box structure of claim 1 wherein an inner surface of said transparent cover exactly abuts on the upper corners of the intellectual cube when said transparent cover covers said base and the wedge-shaped portion of the intellectual cube is disposed within said wedge-shaped groove.

5. The box structure of claim 1 wherein an inner surface of said transparent cover exactly abuts on an upper corner of the intellectual cube when said transparent cover covers said base and the pyramid-shaped part of the intellectual cube is disposed in said pyramid-shaped groove.

6. The box structure of claim 1 wherein said base is provided on a top thereof with a plurality of through holes.

7. A bench for displaying a plurality of box structures; said bench comprising:

a plurality of insertion seats on a top portion of said bench, each of said insertion seats being configured to receive the base of the box structure of claim 1 therein;

a plurality of box structures placed in the top portion of said bench, each of said box structures being the box structure of claim 1;

with the proviso that each base is individually disposed in or on an insertion seat of said plurality of insertion seats.

8. The bench of claim 7 which further includes a transparent cover thereon which covers said bench, said transparent cover having a shape corresponding to said bench.

* * * * *